United States Patent [19]

Johnston

[11] Patent Number: 4,750,237

[45] Date of Patent: Jun. 14, 1988

[54] TROLLEY ASSEMBLY FOR A POCKET DOOR

[75] Inventor: James R. Johnston, Spring Lake, Mich.

[73] Assignee: National Manufacturing Co., Sterling, Ill.

[21] Appl. No.: 926,134

[22] Filed: Nov. 3, 1986

[51] Int. Cl.[4] ..... E05D 15/06

[52] U.S. Cl. ..... 16/102; 16/105

[58] Field of Search ..... 16/91, 102, 105, 106, 16/89

[56] References Cited

U.S. PATENT DOCUMENTS

| | | | |
|---|---|---|---|
| 1,065,794 | 6/1913 | Fitch | 16/105 |
| 1,178,065 | 4/1916 | Ferris | 16/105 |
| 1,192,966 | 8/1916 | Willard | 16/105 |
| 2,775,782 | 1/1957 | Boiu | 16/105 |
| 2,843,872 | 7/1958 | Hannon | 16/105 |
| 3,203,027 | 8/1965 | Ohman | 16/105 |

FOREIGN PATENT DOCUMENTS

| | | | |
|---|---|---|---|
| 1405931 | 9/1975 | United Kingdom | 16/91 |

*Primary Examiner*—M. Jordan

*Attorney, Agent, or Firm*—Edmond T. Patnaude

[57] ABSTRACT

A trolley assembly for a pocket door system comprises a central carrier having a plurality of rollers journaled for rotation thereon. A hanger member having a bolt portion which is threadedly received by the carrier includes a laterally extending pintle. The pintle is received within an aperture of a bracket member secured to an upper edge surface of a door. A locking member is insertable into the aperture after the pintle is received therein and includes an abutment portion selectively positionable in proximity to the hanger member. When inserted into the aperture, the locking member blocks relative movement between the bracket member and hanger member thereby preventing removal of the pintle from the bracket aperture. The door height is conveniently adjusted by removal of the locking member and dissociation of the bracket member from the pintle whereupon the hanger member can be selectively threaded inwardly or outwardly of the carrier.

7 Claims, 2 Drawing Sheets

TROLLEY ASSEMBLY FOR A POCKET DOOR

BACKGROUND OF THE INVENTION

1. Field of the Invention

The present invention relates generally to an improved trolley assembly for a pocket door system, and it relates more particularly to a new and improved trolley assembly having the capability of convenient height adjustment of the door which is suspended therefrom.

2. Description of the Prior Art

Pocket door systems are in widespread use in the construction of building structures of various types. Generally, a pocket door system includes a header assembly having a track on which trolley assemblies are mounted for translational movement. A door is suspended from the trolley assemblies and is, therefore, capable of movement between a closed position and an open position wherein the door is concealed within a pocket formed in the surrounding wall structure. Such a door system offers the advantage over standard hinged door arrangements in that dedication of floor space is not required to open the door from a closed position.

One such pocket door system which has proved particularly reliable in use is disclosed in my co-pending application for, U.S. patent, Ser. No. 926,135 filed Nov. 3, 1986, and includes a unitary header member having a pair of downwardly extending track portions in which a pair of trolley assemblies ride. The header is attachable to the wood structural members forming the rough opening within which the door is installed and provides a mounting member for vertical studs which act together with the surrounding wall surfaces to form the pocket within which the door is movable to assume an open position. In a preferred pocket door system, the trolley assemblies are provided with means for adjusting the height of the door with respect to the floor surface over which it travels. Moreover, an adjustable trolley arrangement permits the door to be properly aligned with respect to the adjacent jamb after its installation.

A disadvantage of known trolley assemblies of the foregoing type is that the adjustment feature typically involves a relatively complicated and often costly mechanism. In addition, some trolley assemblies require the use of specialized tools in order to effect adjustment of the door within the frame opening. Accordingly, it would be desirable to provide a trolley assembly for a pocket door system having a conveniently employed door adjustment feature requiring no specialized tools, and yet, which is readily manufacturable.

SUMMARY OF THE INVENTION

Briefly, there is provided in accordance with the teachings of the present invention a new and improved trolley assembly for a pocket door system comprising a central carrier having a plurality of rollers journaled for rotation thereon. The carrier has a hanger member depending therefrom and a pintle, in turn, extends laterally from the hanger member. The hanger member comprises a bolt portion which is threadedly received by the carrier. The assembly further includes a bracket comprising a plate portion adapted for connection to a door and an attachment portion having an aperture for attachment of the bracket to the pintle of the hanger member. The aperture is configured with a pin receiving portion and a head receiving portion. A locking member is insertable into the aperture of the bracket and is configured to be retained within the aperture at a position directly below the hanger member. In such a position, the head of the pintle is prevented from being passed through the aperture. Alternatively, when the locking member is removed, the head of the pintle is freely capable of being passed through the aperture. By such an arrangement, a pocket door may be adjusted in height by simply removing the locking member, whereupon the head of the pintle can pass through the aperture of the brackets, and thus, the door brackets may be dissociated from the hanger member. The hanger member may then be adjusted vertically by threading it in or out of the carrier. Once the desired height adjustment is achieved, the door is simply rehung by restoring the pintle to its original position within the aperture of the door bracket. Finally, to prevent inadvertent removal of the pintle from the door bracket aperture the locking member is reinstalled in the aperture whereupon the head of the pintle is again obstructed from passing through the aperture of the door bracket.

BRIEF DESCRIPTION OF THE DRAWINGS

The foregoing and other novel features of the present invention will be better understood by a reading of the following detailed description taken in connection with the accompanying drawings wherein.

DETAILED DESCRIPTION OF THE INVENTION

Figure 1:
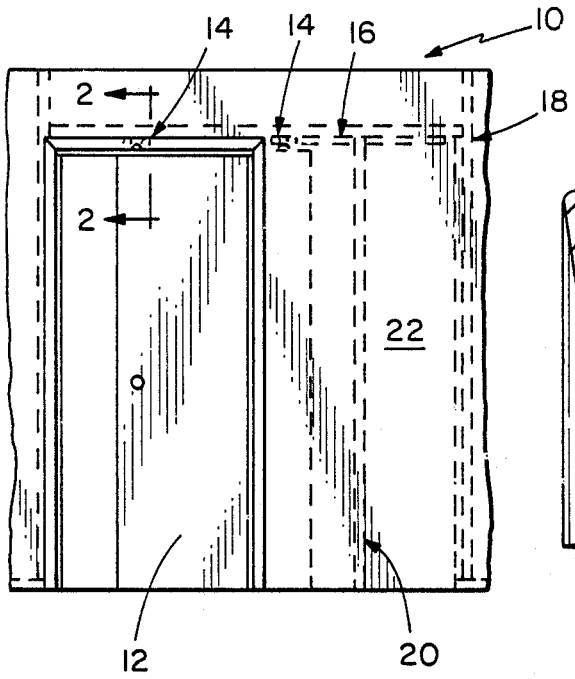
FIG. 1 is an elevational view illustrating a pocket door assembly suitable for using trolley assemblies constructed in accordance with the principles of the invention.

Referring now to the drawings, and initially to FIG. 1, a typical pocket door system, designated generally by the reference numeral 10, is shown as comprising a door 12 moved to a partially open position and suspended on trolley assemblies 14 which ride in a header 16. The pocket door assembly 10 is installed within a rough frame opening, designated generally by the reference numeral 18, and includes a plurality of stud members 20 which together with a wall surface covering 22 form a pocket for receiving the door 12.

Figure 2:
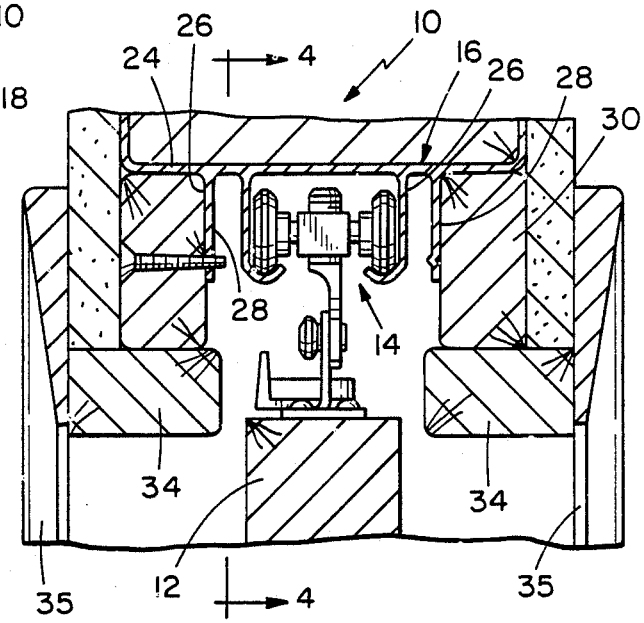
FIG. 2 is a cross-sectional view of a pocket door system header assembly taken along the lines 2—2 of FIG. 1.

Turning now to the cross-sectional view of FIG. 2, the header 16 can be seen to comprise a unitary member preferably extruded from a lightweight metal and includes a central plate portion 24 having a pair of downwardly extending tracks 26 depending therefrom. The header 16 further includes a pair of wall portions 28 disposed on opposite sides of the tracks 26 serving to provide attachment surfaces for wood nailing members 30. The nailing members 30, in turn, provide a surface for attachment of the surrounding wall covering 22 as well as for the attachment of casing 32 which provides a finished door opening. Jamb members 34 are secured to the nailing members 30 and serve to trim the finished door opening whereupon the header 16 and trolley assemblies 14 are concealed from view. Suitable casing 35 is used to trim the finished door opening.

Figure 3:
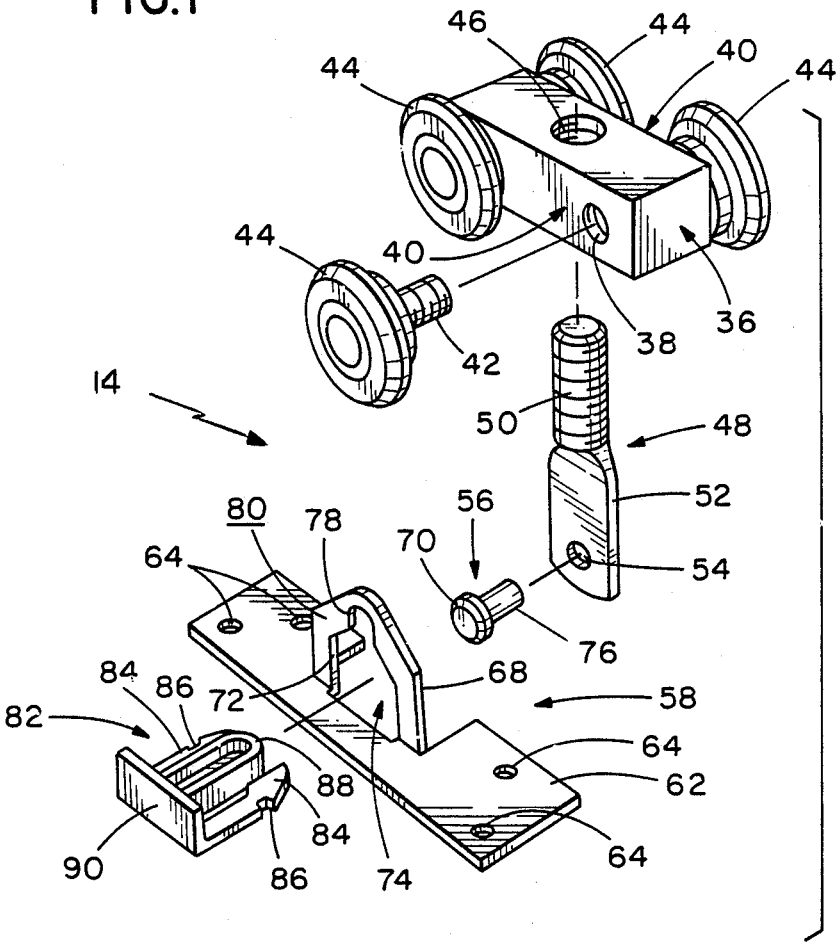
FIG. 3 is an exploded perspective view of a trolley assembly in accordance with the invention.

The component parts of a trolley assembly 14 constructed in accordance with the principles of the invention are best seen in the exploded perspective view of FIG. 3. The assembly 14 includes a central carrier 36 having cylindrical bores 38 (only one of which can be seen) formed in opposite side walls 40 thereof. The bores 38 receive partially threaded shafts 42 each of which serves to journal a roller 44 for rotation with respect to the carrier 36. Preferably, the assembly 14 includes two pairs of rollers 44, the rollers 44 of each pair being spaced on opposite sides of the carrier 36 by such a dimension as to correspond with the spacing of the tracks 26 of the header 16 thereby providing for stability of the trolley assembly 14 as it moves within the tracks 26. The carrier 36 further includes a centrally positioned bore 46 which is threaded to receive a downwardly extending hanger bolt 48. The hanger bolt 48 is provided at its upper end with a running thread portion 50 and a lower plate portion 52, the lower plate portion 52 having an aperture 54 which receives a press fitted pintle 56. As will be described in greater detail hereinafter, the running thread portion 50 of the hanger bolt 48 serves to provide for manual adjustment of the spacing between the pintle 56 and the carrier 36.

In order to suspend the door 12 from the trolley assembly 14, a bracket member 58 is attachable to the upper edge 60 of the door 12 by means of a plate portion 62 having a plurality of holes 64 for receiving suitable wood screws 66, or the like. The bracket 58 further includes an upstanding hanger portion 68 which is stamped and formed at right angles to the surface of the plate portion 62. The pintle 56 is provided with an enlarged head portion 70 which is capable of being received by an enlarged portion 72 of an aperture 74 formed in the hanger portion 68 of the bracket 58. A pin portion 76 of the pintle 56 is receivable by a relatively small portion 78 of the aperture 74. The portion 78 of the aperture 74 is preferably contoured to match the circular shape of the pin portion 76 of the pintle 56. Thus, when it is desired to hang the door 12 from the trolley assembly 14 the enlarged portion 72 of the aperture 74 is aligned with the head portion 70 of the pintle 56 and the door 12 is moved laterally with respect to the trolley assembly 14 such that the relatively small portion 78 of the aperture 74 is positioned over the pin portion 76 of the pintle 56 whereupon the door 12 may be released to rest on the pintle 56 with the head portion 70 of the pintle 56 positioned adjacent face portion 80 of the hanger portion 68 of the bracket 58.

To retain the pintle 56 in seated disposition within the aperture 74 of the bracket member 58, in accordance with the present invention a locking member 82 is selectively attachable to the hanger portion 68 of the bracket 58. The locking member 82 has a pair of arm members 84 provided with notches 86 such that the arm members 84 cooperate with the edges of the enlarged aperture portion 72 to hold the locking member 82 to the bracket member 58. In locked position, an abutment portion 88 of the locking member 82 is disposed beneath the head portion 70 of the pintle 56 and hanger bolt 48 whereupon the hanger bolt 48 is prevented from moving downwardly, as viewed in FIG. 3 for example, and thus the head portion 70 of the pintle 56 is unable to pass through the enlarged aperture portion 72 of the bracket member 58. The pin portion 76 of pintle 56 is thereby retained within the relatively small portion 78 of the bracket aperture 74. A suitable tab 90 provides a means for manually gripping the locking member 82 when removal or installation of the locking member 82 is desired.

OPERATION

Figure 4:
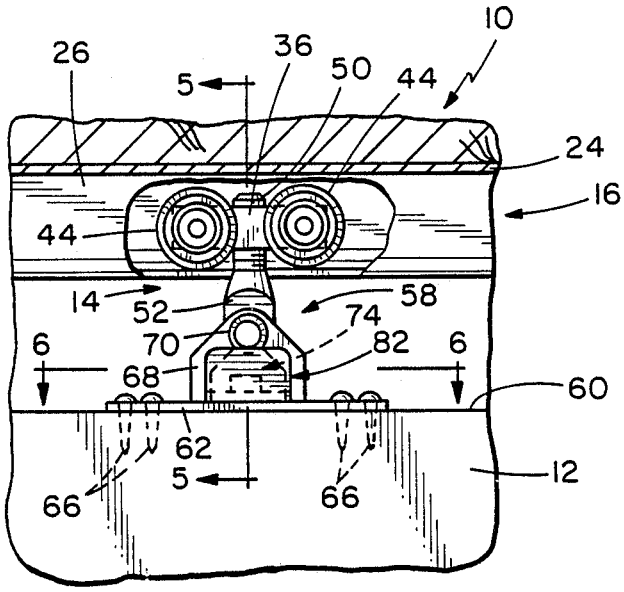
FIG. 4 is a cross-sectional view taken along the lines 4—4 of FIG. 2.
Figure 5:
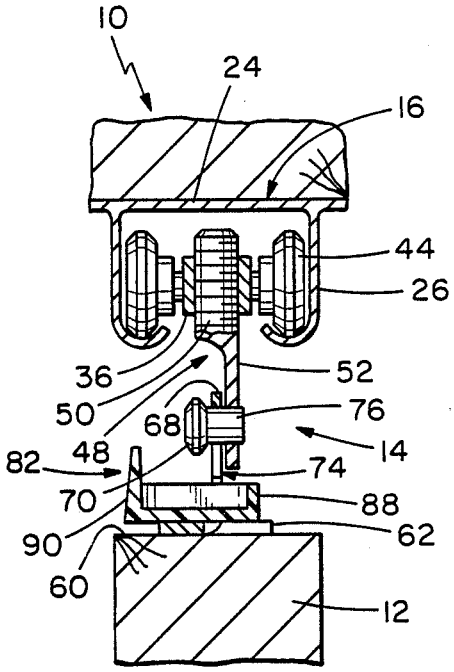
FIG. 5 is a cross-sectional view taken along the lines 5—5 of FIG. 4.
Figure 6:
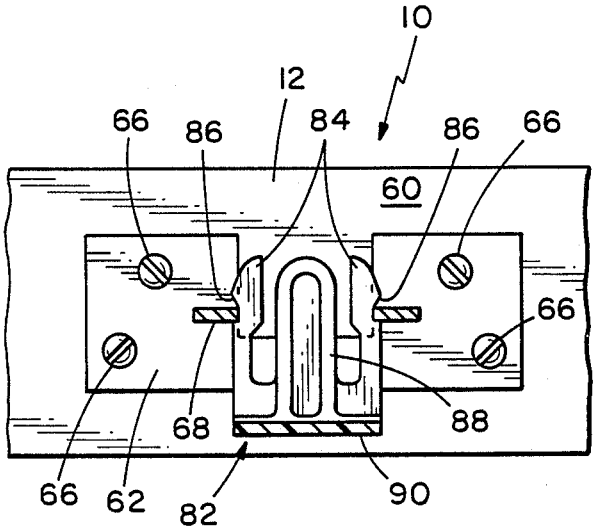
FIG. 6 is a cross-sectional view taken along the lines 6—6 of FIG. 4.
Figure 7:
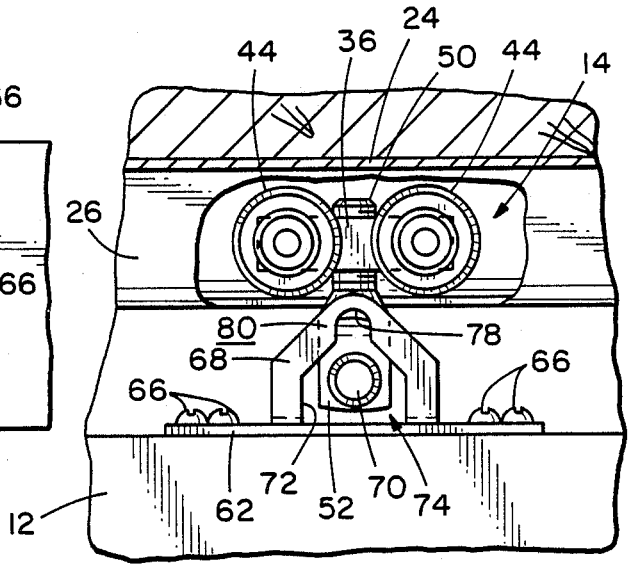
FIG. 7 is a cross-sectional view similar to FIG. 4 illustrating the manner in which the door and bracket member is removed from the hanger member of the trolley assembly when height adjustment of the door is desired.

The operation of a trolley assembly 14 in accordance with the invention can best be seen by the cross-sectional views of FIGS. 4, 5, 6 and 7 wherein the trolley assembly 14 is illustrated as attached to a typical door 12 and suspended from tracks 26 of a header 16. In the views of FIGS. 4 and 5 for example, the door is illustrated in its installed condition with the hanger portion 68 of the bracket 58 suspended from the pintle 56, the relatively small portion 78 of the aperture 74 resting on the pin portion 76 of the pintle 56. In addition, the bracket 58 is prevented from removal from the hanger bolt 48 and pintle 56 by disposition of the abutment portion 88 of the locking member 82 in vertical alignment with the pintle 56 whereby the head portion 70 of the pintle is prevented from removal through the enlarged portion 72 of the bracket aperture 74. When it is desired to remove the door 12 from the installed disposition within the pocket door assembly 10, as best seen in FIG. 7, the locking member 82 may be manually removed by grasping the tab 90 and moving the locking member translationally whereupon the arms 84 release from engagement with the hanger portion 68 of the bracket 58. The door 12 can then be lifted such that the head portion 70 of the pintle 56 becomes aligned with the enlarged portion 72 of the aperture 74, whereupon the door 12 may be moved laterally and thus separated from the hanger bolt 48 and carrier 36. Once separated, the door 12 may be adjusted by simply rotating the hanger bolt 48 with respect to the carrier 36 until the desired door height or door plumb adjustment is achieved.

It can be appreciated that the trolley assembly 14 of the instant invention offers significant advantages over prior art mechanisms for suspending pocket doors. The trolley assembly 14 provides for adjustment of a pocket door 12 without the need for any specialized tools due to the construction of the hanger bolt 48 and bracket 58 which together permit the door 12 to be removed by entirely manual means. Moreover, the height adjustment of the door 12 is achieved by simple manual adjustment of the hanger bolt 48 with respect to the carrier 36, and thus, the height of the pintle 56 from which the door bracket 58 is suspended is conveniently altered. Since the trolley assembly 14 comprises relatively few operative components, advantages of reduced cost can be achieved in its manufacture, and therefore, the assembly 14 can be made less expensively than prior art devices having complex adjustment mechanisms.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed as new and desired to be secured under Letters Patent of the United States is:

1. A trolley assembly for a pocket door system, comprising in combination a carrier;

a roller journaled in said carrier for rotation;

a hanger member depending from said carrier;

a bracket including a plate portion and a hanger portion, said plate portion being adapted for connection to a door with said attachment portion extending upwardly from said door;

first hanger means being affixed to said hanger member and extending laterially therefrom;

second hanger means on said hanger portion of said bracket, said first and second hanger means being removably connected together for attaching said hanger member to said bracket when said first and second hanger means are in a first relative position; and locking means selectively connectable to said bracket to lock said first and second hanger means in said first relative position, said locking means having an abutment portion disposed in close proximity to said hanger member when connected to said bracket.

2. The trolley assembly of claim 1 including a pair of rollers journaled on said carrier for rotation and said hanger member connects to said carrier at a point intermediate between said rollers.

3. A trolley assembly for a pocket door system comprising a carrier;

a roller journaled in said carrier for rotation;

a hanger member depending from said carrier;

a pintle extending laterally from said hanger member, said pintle having a head portion and a pin portion;

a bracket including a plate portion and a hanger portion, said plate portion adapted for connection to a door and said attachment portion having an aperture for attachment of said bracket to said pintle;

said aperture configured with a pin receiving portion and a head receiving portion;

locking means selectively connectable to said bracket, said locking means having an abutment portion disposed in close proximity to said hanger member when connected to said bracket;

said pin receiving portion of said aperture receiving said pin portion of said pintle when said locking means is connected to said bracket;

whereby when said abutment portion of said locking member is disposed in close proximity to said hanger member the head of said pintle is prevented from being passed through said aperture of said bracket.

4. The trolley assembly of claim 3 wherein said pintle is spaced from said carrier and the spacing of said pintle with respect to said carrier is adjustable.

5. The trolley assembly of claim 4 wherein said hanger member includes a bolt and said bolt is threadedly received by said carrier.

6. The trolley assembly of claim 3 wherein said locking means includes a pair of arms and said arms are engagable with said aperture to connect said locking means to said bracket.

7. The trolley assembly of claim 6 wherein said locking means further includes a tab for manually connecting or disconnecting said locking means with respect to said bracket.

* * * * *